US010837282B2

(12) United States Patent
Schwöller

(10) Patent No.: US 10,837,282 B2
(45) Date of Patent: Nov. 17, 2020

(54) INTERNAL COMBUSTION ENGINE

(71) Applicant: Johann Schwöller, Strasswalchen (AT)

(72) Inventor: Johann Schwöller, Strasswalchen (AT)

( * ) Notice: Subject to any disclaimer, the term of this patent is extended or adjusted under 35 U.S.C. 154(b) by 278 days.

(21) Appl. No.: 15/515,422

(22) PCT Filed: Sep. 30, 2015

(86) PCT No.: PCT/EP2015/072636

§ 371 (c)(1),
(2) Date: Jun. 19, 2017

(87) PCT Pub. No.: WO2016/050885

PCT Pub. Date: Apr. 7, 2016

(65) Prior Publication Data

US 2018/0051563 A1 Feb. 22, 2018

(30) Foreign Application Priority Data

Sep. 30, 2014 (DE) ..... 10 2014 114 183

(51) Int. Cl.

| | |
|---|---|
| ***F01B 1/12*** | (2006.01) |
| ***F01B 21/02*** | (2006.01) |
| ***F01B 1/04*** | (2006.01) |
| ***F02B 73/00*** | (2006.01) |
| *F02F 7/00* | (2006.01) |
| *F02B 75/22* | (2006.01) |

(52) U.S. Cl.

CPC ..... *F01B 1/12* (2013.01); *F01B 1/04* (2013.01); *F01B 21/02* (2013.01); *F02B 73/00* (2013.01); *F02B 75/22* (2013.01); *F02F 7/0012* (2013.01); *F02F 7/0031* (2013.01)

(58) Field of Classification Search

CPC .... F01B 1/12; F01B 1/04; F01B 21/02; F01B 9/00; F01B 9/02; F02B 73/00; F02F 7/0012

USPC ..... 123/54.4

See application file for complete search history.

(56) References Cited

U.S. PATENT DOCUMENTS

| | | | |
|---|---|---|---|
| 4,337,623 | A | 7/1982 | Kronogård |
| 4,361,059 | A | 11/1982 | Kronogård |

(Continued)

FOREIGN PATENT DOCUMENTS

| | | |
|---|---|---|
| CN | 101451580 | 6/2009 |
| CN | 101598046 | 12/2009 |

(Continued)

OTHER PUBLICATIONS

German Search Report, dated Apr. 30, 2014, for priority application DE 10 2014 114 183.0, filed on Sep. 30, 2014. Twelve pages. German.

(Continued)

*Primary Examiner* — Lindsay M Low
*Assistant Examiner* — Omar Morales
(74) *Attorney, Agent, or Firm* — HoustonHogle LLP

(57) ABSTRACT

An internal combustion engine according to the invention comprises at least two engine blocks which are coupled to one another and each of which includes at least two cylinders, each cylinder being connected to a common drive shaft via a transmission and a clutch. If there is a problem with one engine block, same can be disconnected from the drive shaft so that the engine can continue to operate by means of the other engine block.

18 Claims, 13 Drawing Sheets

(56) References Cited

U.S. PATENT DOCUMENTS

Figure 1:
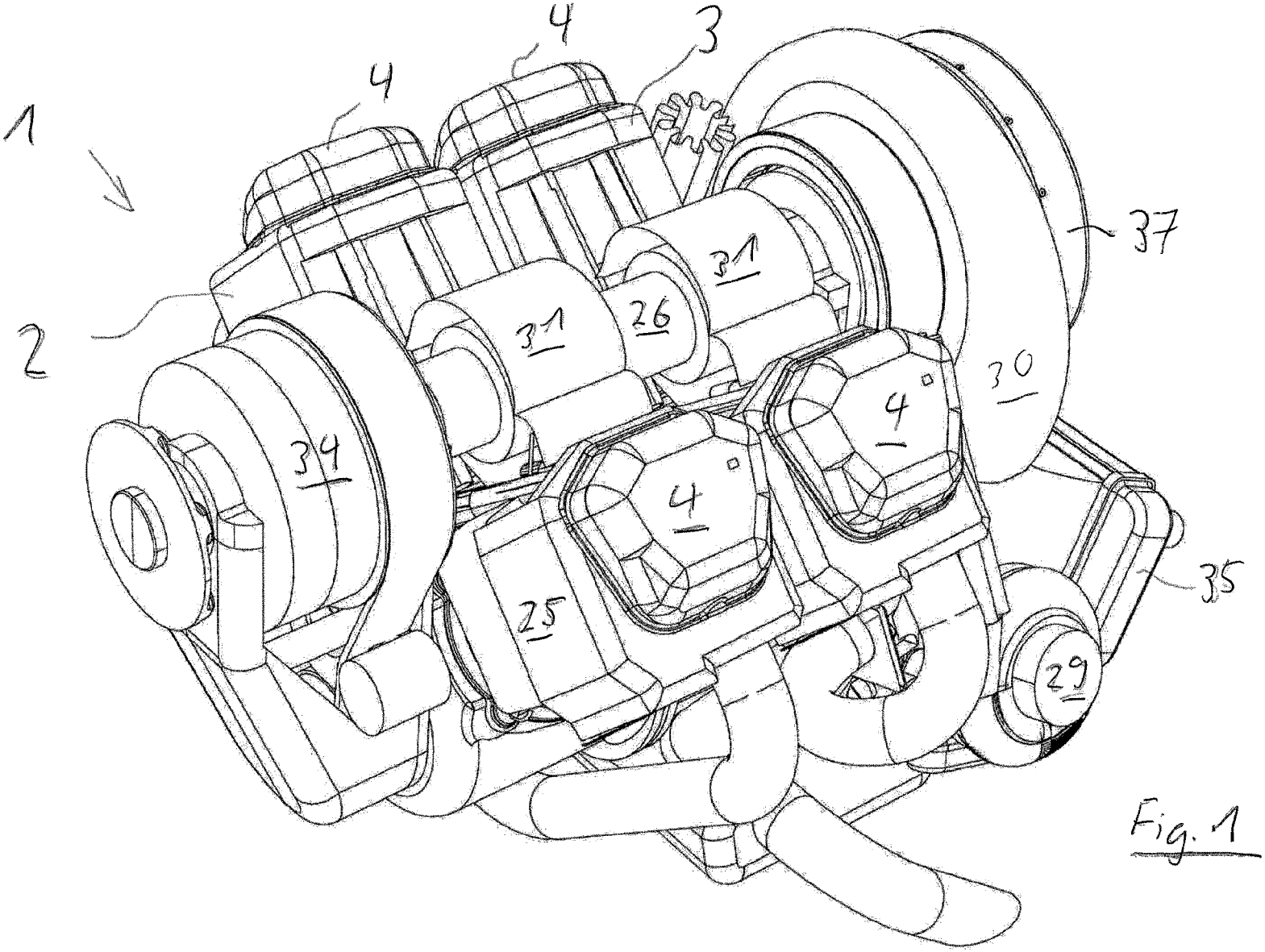

| | | | | |
|---|---|---|---|---|
| 4,417,551 | A * | 11/1983 | Kronogard | F02B 73/00 123/198 F |
| 4,625,583 | A | 12/1986 | Kronogård | |
| 5,537,971 | A | 7/1996 | Pong | |
| 6,306,056 | B1 * | 10/2001 | Moore | B60K 5/08 475/5 |
| 2007/0079778 | A1 * | 4/2007 | Atkinson | F02B 63/06 123/62 |
| 2010/0050977 | A1 * | 3/2010 | Park | F02F 7/0085 123/195 R |
| 2014/0251246 | A1 * | 9/2014 | Flynn | F01L 1/34 123/90.16 |

FOREIGN PATENT DOCUMENTS

| | | | |
|---|---|---|---|
| CN | 102345507 | | 2/2012 |
| CN | 203685386 | | 7/2014 |
| DE | 27 47 131 | A1 | 4/1978 |
| DE | 31 32 367 | A1 | 8/1982 |
| DE | 31 32 368 | A1 | 8/1982 |
| DE | 32 26 458 | A1 | 2/1983 |
| DE | 3619351 | | 10/1987 |
| DE | 198 39 231 | A1 | 3/2000 |
| DE | 10 2010 005 915 | A1 | 7/2011 |
| DE | 10 2010 022 544 | A1 | 8/2011 |
| DE | 102010022674 | | 12/2011 |
| DE | 10 2011 018 410 | A1 | 1/2012 |
| DE | 10 2013 005 652 | A1 | 10/2014 |
| GB | 2 140 870 | A | 12/1984 |
| GB | 2 344 378 | A | 6/2000 |
| WO | 2012/142993 | A1 | 10/2012 |

OTHER PUBLICATIONS

English Translation of the International Search Report, dated Dec. 9, 2015, from International Application No. PCT/EP2015/072636, filed on Sep. 30, 2015. Three pages.

English Translation of the Written Opinion of the International Searching Authority, from International Application No. PCT/EP2015/072636, filed on Sep. 30, 2015. Five pages.

English Translation of the International Preliminary Report on Patentability, dated Apr. 4, 2017, from International Application No. PCT/EP2015/072636, filed on Sep. 30, 2015. Six pages.

* cited by examiner

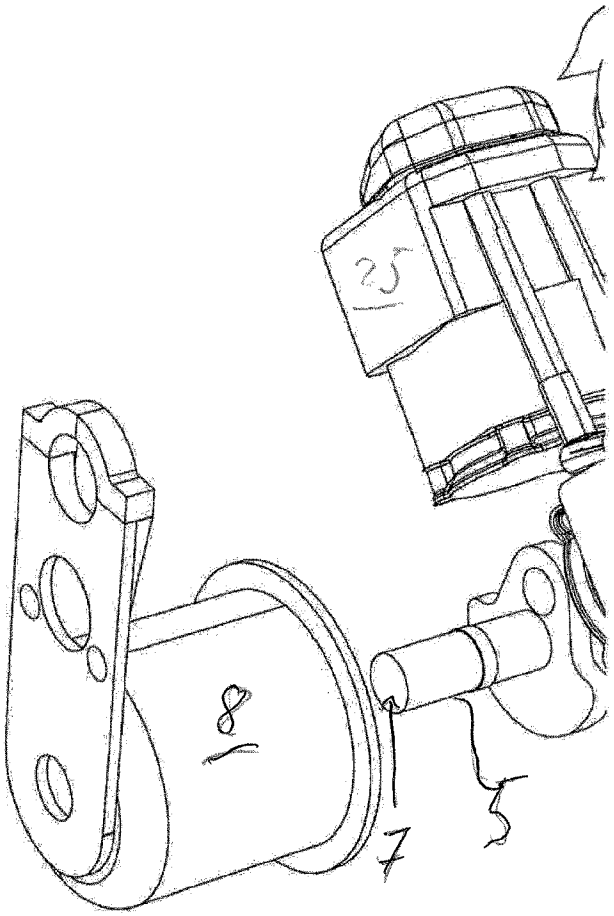
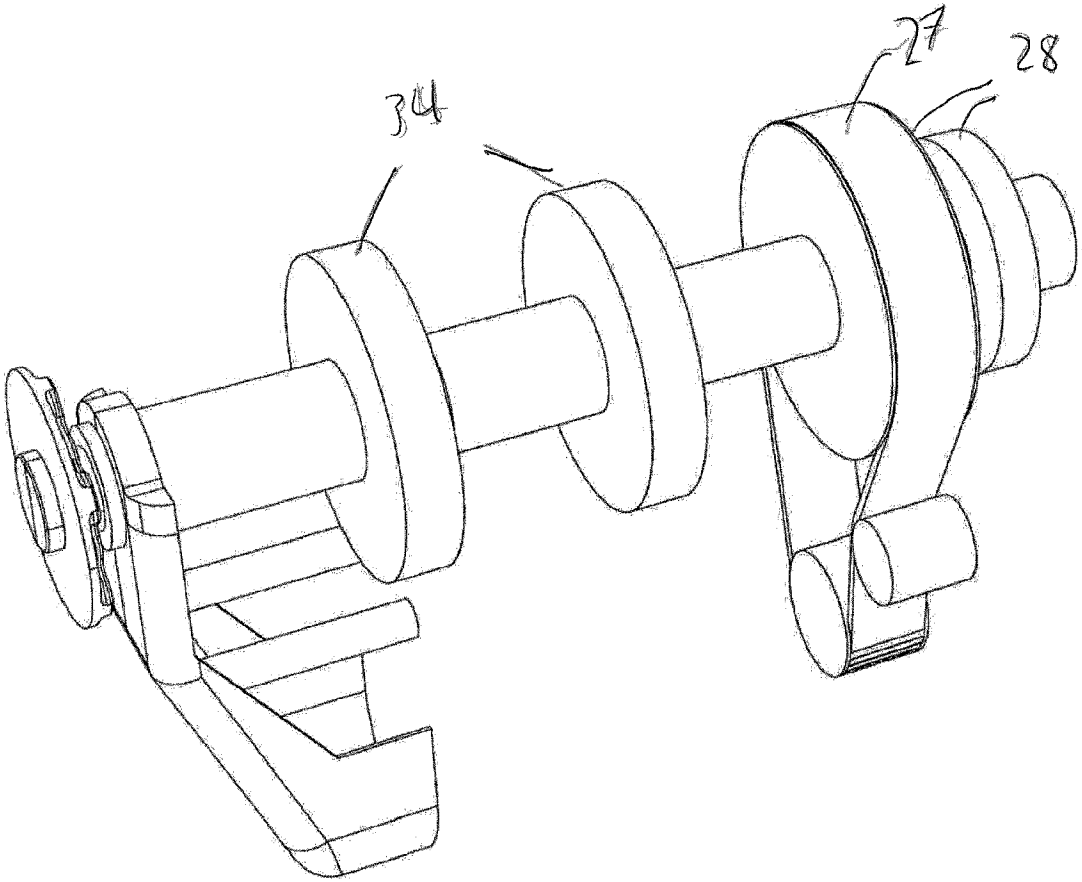
Fig. 6

INTERNAL COMBUSTION ENGINE

RELATED APPLICATIONS

This application is a § 371 National Phase Application of International Application No. PCT/EP2015/072636, filed on Sep. 30, 2015, which claims priority to German Application No. 10 2014 114 183.0, filed on Sep. 30, 2014, both of which are incorporated herein by reference in their entirety.

The present invention relates to an internal combustion engine.

A vehicle engine can be derived from DE 31 32 368 A1. This vehicle engine comprises at least two engine blocks. The two engine blocks each comprise their own crankshaft. One of the crankshafts is connected to an output shaft by means of a lock-up/freewheel clutch. Between the freewheel clutch and the output shaft, a first transmission is provided. Furthermore, a second transmission is provided connecting the crankshaft to a transmission shaft portion by means of a freewheel. The transmission shaft portion is part of a transmission shaft extending in parallel to the crankshafts. The transmission shaft comprises a second portion. The output of the engine block is, via the transmission shaft, transmitted to the same output shaft to which the force of the second engine block is also transmitted.

DE 27 47 131 A1 discloses a vehicle power unit. This document discloses several engine arrangements and vehicle power units, in which, for example, two in-line engines are arranged next to one another or in V-shape with respect to one another and are coupled to one another by means of a "frame". Furthermore, the vehicle power unit may be adapted such that two engine blocks in V-shape are arranged in V-shape with respect to one another. An output shaft, which is arranged beneath the cylinder heads, is also disclosed.

From DE 10 2013 005652 A1, a clutch device for connecting internal combustion engine parts in a conformal manner and with the correct firing order can be derived. In particular, a claw clutch and a friction clutch are provided. The friction clutch is to accelerate a disengaged second internal combustion engine part up to a rotational speed until the rotational speed difference permitted for the process of engagement is reached or underrun. To this end, the friction clutch is to be driven accordingly in order to first bridge the claw clutch. By operating the claw clutch, first front faces of the at least three claws are brought in sliding contact with a second basic face. The first front faces are to slide on the second basic face while complying with a permitted rotational speed difference. An engaging process is to be initiated automatically by the transition of a second basic face to a second engaging phase and thus to the associated free travel, when the required angular position is set and the respective claw can engage the associated claw pocket.

DE 10 2010 022544 A1 describes a device for balancing the free inertial forces and inertial torque in internal combustion engines having a crank drive designed in a divided manner. The introduction of the description of this document discloses that it is known from the prior art to switch off one or more cylinders of the internal combustion engine during partial-load operation and switch them on during full-load operation such as to improve the exploitation of the degree of efficiency of an internal combustion engine during partial-load operation. Switching off the cylinders during partial-load operation reduces both the fuel consumption and the exhaust emissions of the engine.

A method and a device for operating a multi-cylinder internal combustion engine can be derived from DE 10 2010 005915 A1. This document describes a synchronizing clutch on a mass balancing shaft of a permanently operated cylinder unit that is required for switching on or off a partial cylinder unit. The mass balancing shaft and thus the crankshaft of the permanently operated cylinder unit are to be connected and disconnected, via a gear engagement, to the crankshaft of the cylinder unit that can be switched on and switched off. This is to achieve a reduction of the required installation space length. Moreover, an additional shaft for operating the process of switching on and switching off the cylinders is no longer necessary.

DE 32 26 458 A1 discloses an engine, in which one crankshaft is divided into two sections. The ends of the crankshaft sections carry bevel gears cooperating with a multi-disk clutch, which is operated in a suitable manner such as to connect the two crankshaft sections or to keep a left cylinder group inactive. An output shaft can be connected to a right cylinder group, and a bevel gear of an associated crankshaft section drives, also via another bevel gear, an air compressor, accommodated within the cylinder, which is connected to an air intake manifold of the engine via a channel.

DE 31 32 367 A1 describes a vehicle engine composed of blocks, each of which comprises at least one cylinder and which comprise on their end faces mutually similar fastening means, which are arranged symmetrically with respect to a vertical center plane. Preferably, the engine comprises one block having an odd cylinder number and one block having an even cylinder number, for example 2 or 3 cylinders, respectively, which allow, in addition to combinations of 2+2 and 3+3, combinations having an odd overall number of cylinders. The blocks may be directly connected to one another, wherein the housing comprising the auxiliary means is connected to the free end of one of the blocks, while a housing for a transmission to an output shaft is connected to the free end of the other block. Alternatively, the blocks may be connected to one another via a housing, which comprises a transmission for an output shaft. The transmission housing may then comprise clutches for selectively connecting the crankshafts of the two blocks to the output shaft. According to one embodiment, the vehicle engine comprises a first engine block and a second engine block, which are connected to one another via a transmission housing. Further, a control gear having an output shaft is provided. Furthermore, a differential for a front drive is provided, in which the power is transmitted via a hollow shaft arrangement. The power is to be transmitted by means of a chain drive or a belt drive. One drive portion forms part of the housing for two clutches and freewheels. A crankshaft is connected to a central shaft, which carries a clutch disk and a freewheel 46*a*, which cooperate with the housing. The central shaft is continued by a freewheeling extension passing through another clutch housing. One crankshaft is connected to a torque converter. Furthermore, the crankshaft comprises a clutch disk. The clutch disk has a shaft fastened thereto, which encloses the shaft. The shaft may cooperate with clutch housings by means of a freewheel and may also directly cooperate with the clutch housing by means of a clutch disk 53. This vehicle engine is to achieve a reduction of the fuel consumption by interrupting the fuel supply for certain cylinders. In particular, a microcomputer is disclosed which opens or closes respective clutches when the output power changes depending on the traffic or road conditions.

An internal combustion engine having a main engine with a first crankshaft portion rotating about a rotational axis and an additional engine with a second crankshaft portion can be derived from WO 2012/142993. Between the crankshaft portions, a synchronizing clutch is arranged, which is formed by a friction clutch and a positive clutch. The friction clutch is designed as a multi-disk clutch and serves to match the rotational speeds of the two crankshaft portions during the synchronization thereof. The positive clutch comprises positive elements associated to the first crankshaft portion and positive elements associated to the second crankshaft portion, which, when the positive clutch is operated at a predetermined rotational speed difference between the two crankshaft portions, forms the positive fit therebetween by axially engaging one another. The positive elements are formed by claws arranged trapezoidally in the axial direction.

The object of the present invention is to provide a compact and simply structured engine, which guarantees a high level of operational safety.

To achieve this object, the invention provides the features specified in claim 1. Preferred embodiments thereof are specified in the dependent claims.

According to the invention, an internal combustion engine comprises at least two engine blocks which are coupled to one another and each of which includes at least two cylinders, each cylinder being connected to a common drive shaft via a transmission and a clutch.

For the purpose of the invention, an engine block means a housing comprising, in addition to cylinders and corresponding cylinder heads, a crankshaft bearing, a crankcase and a corresponding water or air cooling system.

Since both engine blocks can be decoupled from the drive shaft via the corresponding clutch individually, the engine is designed in a redundant manner. This way, both engine blocks can be operated completely independently of one another. This renders a high level of safety when employing the engine in aircrafts, because if one engine block fails, it can be automatically or manually decoupled, while the other engine block continues to operate without being decelerated or blocked by the failing engine block.

The two engine blocks may be designed in V-shape such that the respective cylinder heads are arranged in V-shape and the drive shaft is arranged in the region of the V-clearance between the cylinder heads.

Such an arrangement of the drive shaft allows for a compact composition of the engine.

The two engine blocks may also be adapted such as to form a boxer engine. In this case, the drive shaft can be arranged above or below the cylinders.

Each engine block may comprise its own crankshaft.

The engine according to the invention has thus no continuous crankshaft. It is thus not necessary to transmit the drive torque from one engine side via the crankshaft to the one-sided output.

According to the invention, the torque is output via ends of the crankshafts arranged on the output side or outside. Thereby, a crankshaft cheek arranged on the inside serves, together with the bearing, only to guide and balance. This allows for a very simple and light-weight design of the crankshafts, which can be manufactured cost-efficiently.

With this arrangement, the crankshaft can be designed as an assembled crankshaft, that means as a lightweight crankshaft composed of single components. This way, the connecting rods do not require any threaded bearing connection and can have a lower weight.

By having the assembled crankshaft designed as a joint assembly, it is mass-optimized and saves vibration-reducing components in the engine. Basic components are, for example, the crankshaft cheeks designed as fine cut parts or forged cheek segments. Specific contour elements such as collars or joggles provide an enlarged joint length for the cheek-bearing connection and guarantee the separation of the thermal and geometric notch. This results in an improved component rigidity.

A forged crankshaft or crankshaft milled from solid requires connecting rods which must be adapted such that they can be, on the bearing to the crankshaft, disconnected for mounting purposes. This means more weight and higher manufacturing effort.

The transmissions may be designed as belt transmissions or gear transmissions.

Furthermore, the two transmissions may be arranged on the ends of the crankshafts connecting them to the drive shaft on the output sides.

The arrangement of the gear engagements on the outside achieves a small distance between the cylinder pairs of the two engine parts, which can render a high running smoothness.

The two transmissions may, according to a preferred embodiment, be arranged in the region in which the two engine blocks are connected or coupled to one another.

The transmissions are then preferably designed as gear transmissions.

Such a design and arrangement results, compared to belt transmissions arranged on the outside or on the output side, in a higher fatigue strength due to a lower swing-up behavior and reduced rotational vibrations.

In particular, the transmissions may be designed such that one first gear arranged on the crankshaft is in each case connected, via a second gear, to a third gear arranged on the output shaft. This allows for a smaller transmission at a given transmission ratio.

Furthermore, it may be provided that a gear arranged on a camshaft is, via a fourth gear coupled to the second gear, engaged in a way that the camshaft is driven or controlled via the gear pair consisting of the fourth and the fifth gear.

This allows for a camshaft control with almost zero clearance, in particular if these gears are designed as spur gears or bevel gears. This is because such an arrangement does not cause any problems with changes in length. A further advantage is that the entire mechanics are provided in the already existing oil bath of the one or the two engine blocks.

The clutches may be designed such as to allow for coupling the respective crankshaft to the drive shaft in only one single angular position.

This may for example be realized by means of a claw clutch, in which one claw of one half of the claw clutch has a different geometry than the remaining claws such that this one claw can only be coupled into one respective recess of the other half of the claw clutch.

This way, the two engine blocks of the internal combustion engine can be coupled manually, that means by hand, only in this one position during standstill. Coupling them in only one position has the advantage that the engine blocks are almost always coupled in the same angular position such that the balancing of the engine parts remains the same also when the engine parts are reconnected. It is therefore not necessary to adjust the engine parts manually.

The engine may comprise a camshaft arranged on the top-mounted camshaft or on the bottom-mounted camshaft.

If the camshaft is bottom-mounted, the internal combustion engine requires less installation space.

Furthermore, a means for, preferably mechanically, decoupling the rocker arms and the camshaft such as to allow for switching off the cylinders may be provided.

A mechanical decoupling of the rocker arms from the camshafts is realized by a means, by means of which the tappets can be disengaged from the rocker arms such that they are no longer connected to the camshaft.

Alternatively, it may be provided that the push rods in the region of the camshaft are displaced such that the transmission of the lifting movement from the camshaft to the push rod is disengaged.

An associated process of switching off the cylinders makes it possible to switch off one of the two engine blocks or its cylinders and thus continue to operate the other engine block at its optimum operational point in a range between 70% and 80% load.

The cylinders are preferably switched off in the lower partial-load range. In this operational range, the entire engine would achieve a poor efficiency. By switching off individual cylinders by means of closed valves, switched off injection and ignition, these cylinders act as spring load accumulators and consume significantly less energy when running along than in the case in which the gas exchange cause corresponding gas exchange losses when valves open. Consequently, the internal combustion engine, which would, for example, with only 35%, in particular 40%, of the power over all cylinders of both engine blocks, have a poorer efficiency, would instead be operated with only one engine block with 70%, in particular 80%, of the power. This increases the overall efficiency and at the same time reduces the fuel consumption.

The internal combustion engine may comprise a water cooling means for cooling the cylinder heads, wherein at least one centrifugal fan is arranged on the drive shaft, which is also adapted for cooling the cylinders.

The centrifugal fan, which is arranged on the drive shaft, allows for a high-volume flow for cooling the cylinders at low pressure. Such a cooling system makes it possible to supply cooling air selectively in order to support the water cooling means of the cylinder heads. The centrifugal fans also have the effect that the engine does not need to be supplied with a cooling air flow from the outside. Because of the centrifugal fans, the cylinders are always force-cooled as long as the drive shaft is rotating, which means as long as the engine is running.

The internal combustion engine according to the invention comprises all components that are necessary for operating one of the two engine blocks twice; only the drive shaft is provided only once.

There may also be provided two completely separated power supply systems, which are connected to the on-board power system via diodes in order to avoid mutual influences of the power supply systems on one another.

The engine according to the invention preferably comprises two separate cooling circuits and oil circuits and correspondingly two cooling water pumps and two oil pumps.

Consequently, when a first engine block fails, the second engine block is not burdened by the cooling line to be applied to the first engine block.

The internal combustion engine according to the invention is preferably provided for aircrafts, in particular microlight aircrafts.

In order to further enhance the failure safety, the internal combustion engine may also comprise an electric drive such that it is thus designed as a hybrid drive. The additional electric motor also serves for short-term enhancement of the performance, for example during start-up, during short-term climb flights or acrobatic flights.

Since the cooling air supply for the water coolers and oil coolers is integrated via a fan on the common drive shaft, the internal combustion engine according to the invention is also perfectly suitable for helicopters, gyrocopters and other aircrafts and devices, in which there is no external air flow for cooling available.

Thus, another advantage of this engine concept is also that the cylinders are air-cooled, while the cylinder head is water-cooled. In case of a loss of cooling water, the engine can thus continue to run for a certain time in emergency operation also without cooling water, because the heat can also be dissipated via the force-cooled cylinders.

The internal combustion engine according to the invention is preferably structured in a completely redundant manner. That means that all ancillary units are at least provided twice. This is achieved by having, for example, two separated lubrication systems, two separated electric circuits, two generators, two turbochargers etc.

According to another aspect of the present invention, an intermediate plate for connecting at least two engine blocks is provided. The intermediate plate is a plate-shaped component comprising two sealing faces, which are adapted for sealing one side of an engine block in each case, wherein the intermediate plate comprises at least one bearing borehole for receiving at least one bearing of a crankshaft.

Such an intermediate plate serves both for sealing and connecting the two engine blocks.

Furthermore, a bearing opening having corresponding bearing means for bearing the two crankshafts is arranged in the intermediate plate.

The bearing opening may be designed for coaxially bearing two crankshafts.

The two crankshafts are borne in the intermediate plate both in the region of the crank cheek and in the center. To be able to design the axial distance of the bearings of each crankshaft portion large, one crankshaft has a pin-shaped section on the respective end, while the other crankshaft has a tubular section on the respective end. The crankshafts can thus engage one another such that the bearing clearances of each crankshaft are designed significantly larger than they would be in the case in which a separate bearing would be provided in the center of the intermediate plate for each crankshaft portion.

In order to realize the above-described advantages of gear transmissions, these are preferably arranged in the center between the two engine blocks in the region of the intermediate plate.

An engine according to the invention preferably has a cubic capacity between 1500 and 2000 ccm.

The performance of the power unit may, in a naturally-aspirated version, be approximately 150 PS and in the turbo charger version approximately 200 PS. The additional performance due to the electric motor may be approximately 30 PS (continuous load) and 50 PS (peak load).

The internal combustion engine offers more power compared to comparable commercially available four-cylinder aircraft engines, while requiring less installation space. In addition, the internal combustion engine is lighter and more simply structured.

This is, amongst other reasons, because the internal combustion engine comprises two identical V-engines, one of which is designed as rotating left and one as rotating right. The two crankshafts rotate in the same rotational direction. Having the output of the crankshafts on both front sides of the engine allows for bearing the crankshaft ends in mutual engagement in the region of the intermediate plate. This makes it possible to maximize the bearing clearances of these crankshaft portions without elongating the installation length of the engine.

The composition of the internal combustion engine also allows for a simple exchange of the tooth belt, as only the drive shaft and not the entire engine needs to be taken out.

In order to shut down one of the two engine blocks in case of loss of torque or complete failure, sensors are provided, by means of which an operating condition of the two engine blocks can be detected independently from one another.

These sensors may preferably be adapted for independently detecting the torque of the two engine blocks or the exhaust gas temperatures of the two engine blocks or for detecting other suitable characteristics for determining the operating condition. These sensors are therefore in the following subsumed with the term operating condition sensors.

The operating condition sensors may be arranged as torque sensors in both clutches. The torque sensors may be implemented as electronic sensors for torque detection, for example as piezoelectric sensors or contact-free torque sensors. The Fraunhofer ITWM sells an inductive sensor for contact-free detection of torque. The measuring concept of this sensor is based on the anisotropic magnetostrictive effect in ferromagnetic shaft surfaces. This effect causes, depending on the mechanical torsional stresses on the place of measurement, a different magnetic permeability in direction of the tensile stresses and compressive stresses. The sensor serves to measure this change in permeability, which is, in a large measurement range, proportional to the torsional stress on the shaft surface.

Another possibility for torque detection is to provide, on the transmission, a spring-loaded pulley, such as a tensioner pulley, abutting on one run of the belt. Depending on whether the belt transmission drives the drive shaft or the engine block, either the one or the other run of the belt is under tension. This tension can be detected with the tensioner pulley and a corresponding sensor.

In addition and/or alternatively, at least two exhaust sensors may be provided, which are integrated into the exhaust system of the two engine blocks such that the exhaust gas temperatures of the two engine blocks can be monitored independently from one another.

The internal combustion engine according to the invention comprises a controller (not shown), which monitors the torque and/or the exhaust gas temperature of the two engine blocks by means of the sensors. As soon as the torque of one of the two engine blocks has, over a longer period of time, for example more than 0.5 or 1 or 1.5 or 2 or 3 or 4 seconds, a predetermined difference from the other engine block, the controller controls the clutch of the respective engine block and decouples it. This way, the crankshaft of this engine no longer has to rotate and the other engine can continue to operate without the friction resistance of the failing engine block.

Aside from these automatic decoupling processes by means of a controller, manual decoupling may also be provided additionally or alternatively.

If one motor part no longer operates correctly, the driver, in particular the pilot, is notified by the control electronics. They can then decouple the respective engine by manually or electrically operating the respective clutch.

Figure 2:
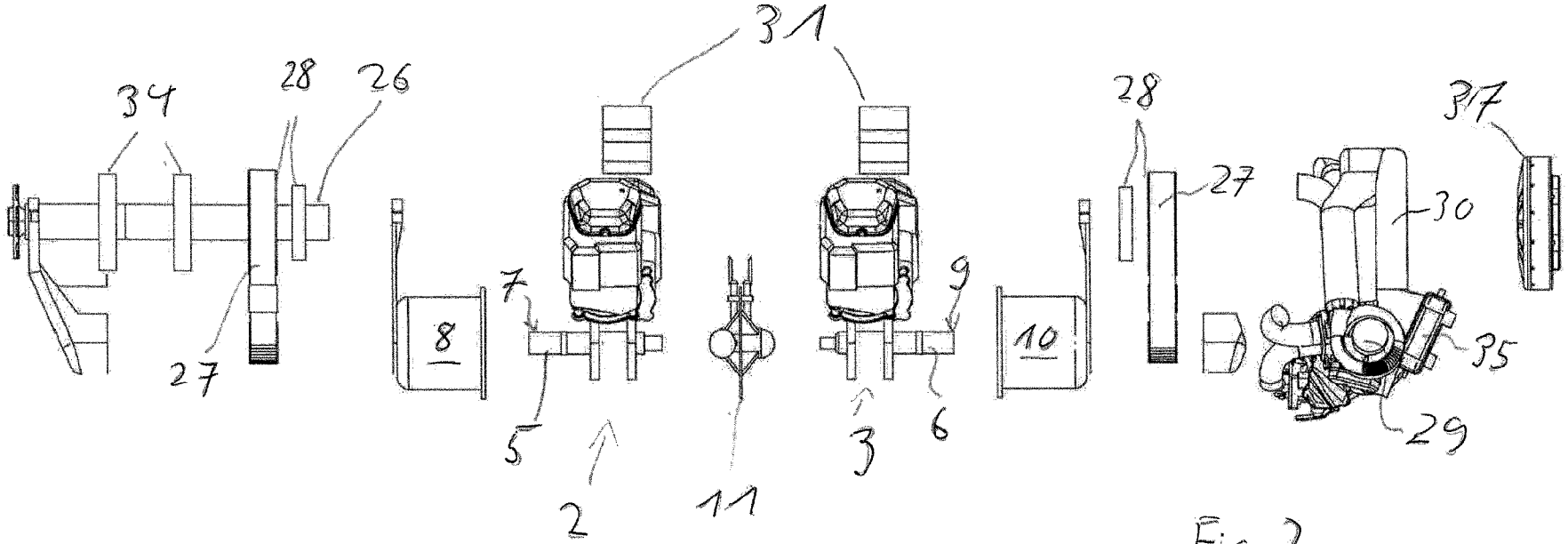
Figure 3:
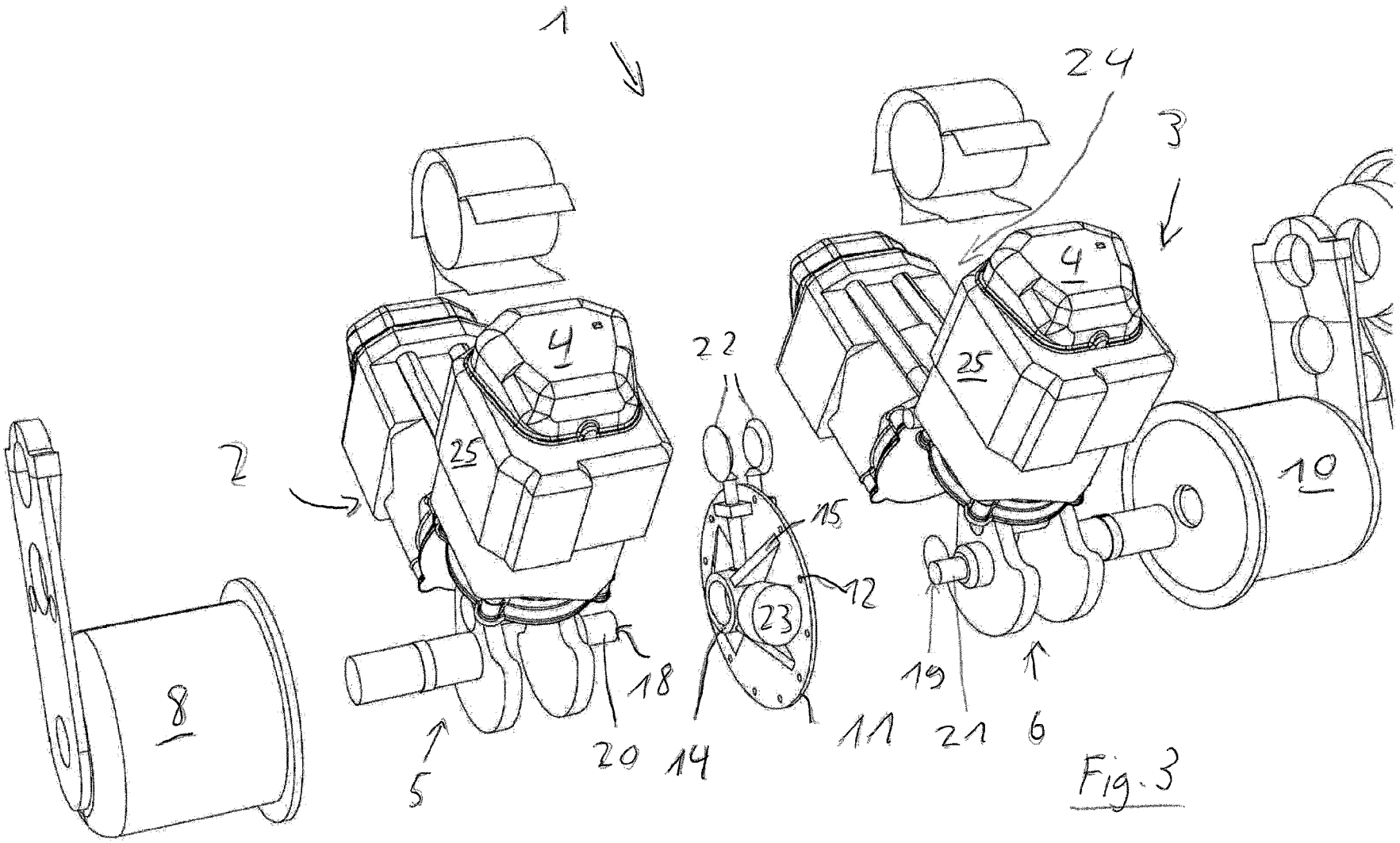
Figure 4:
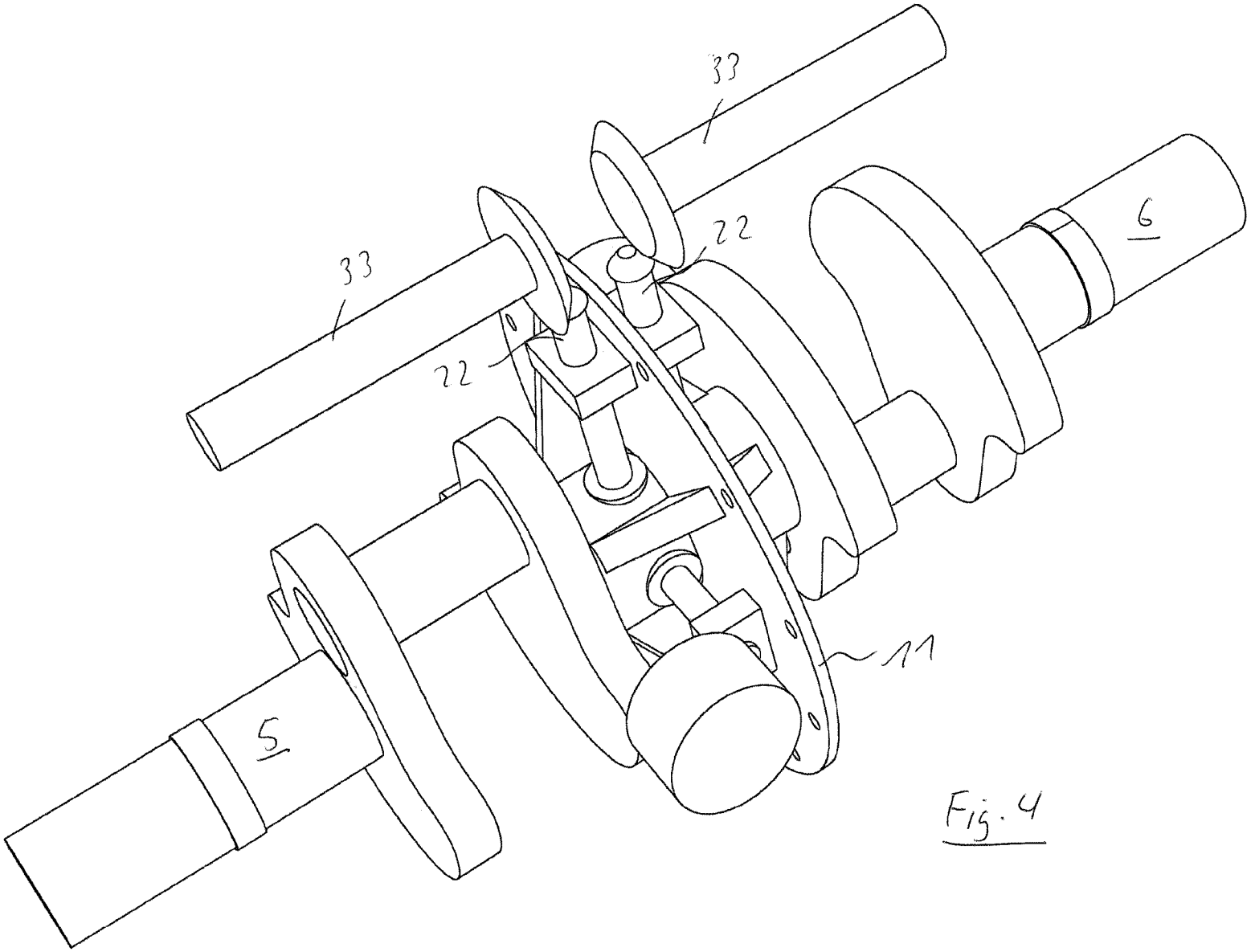
Figure 5:
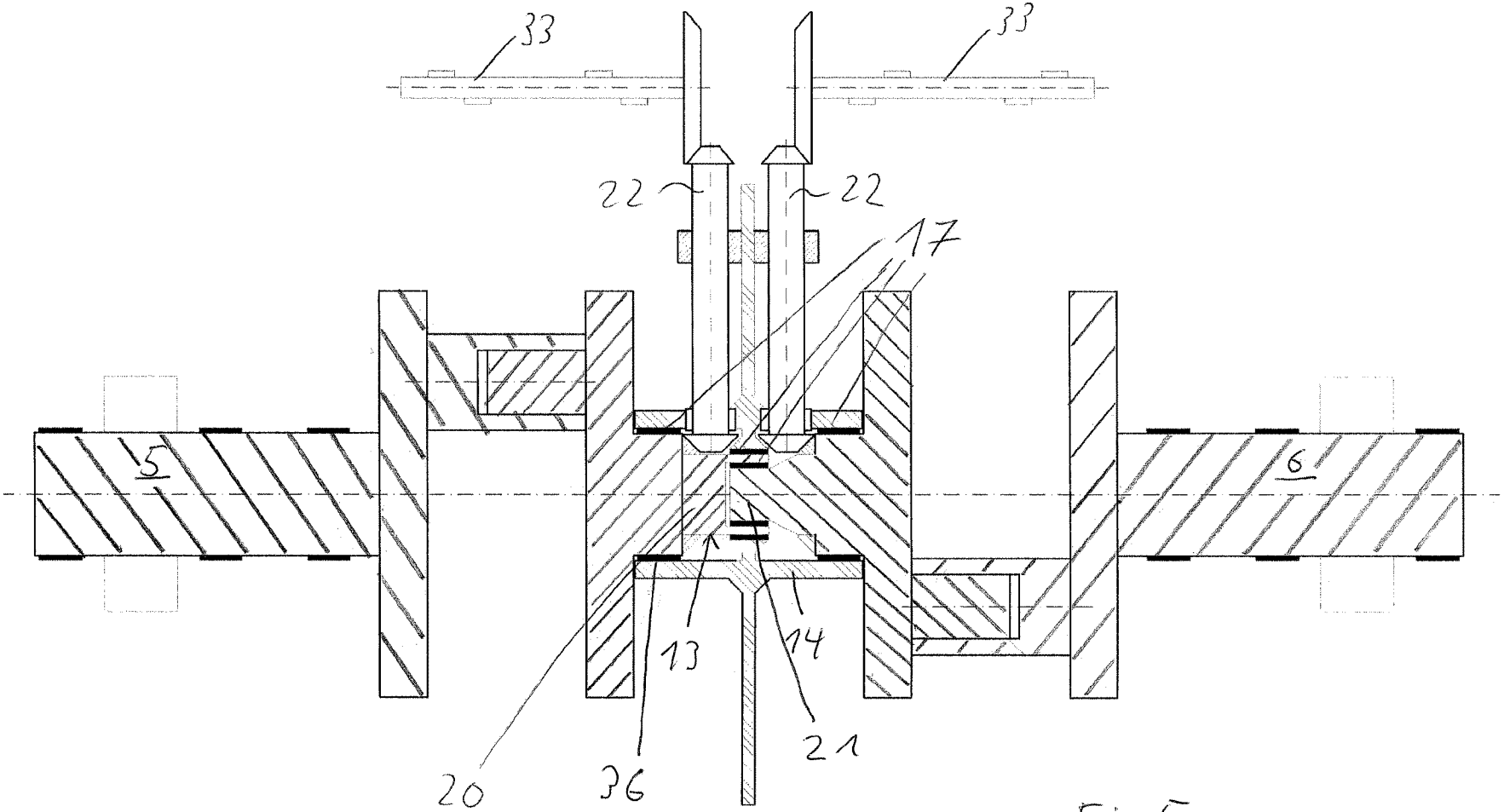
Figure 7:
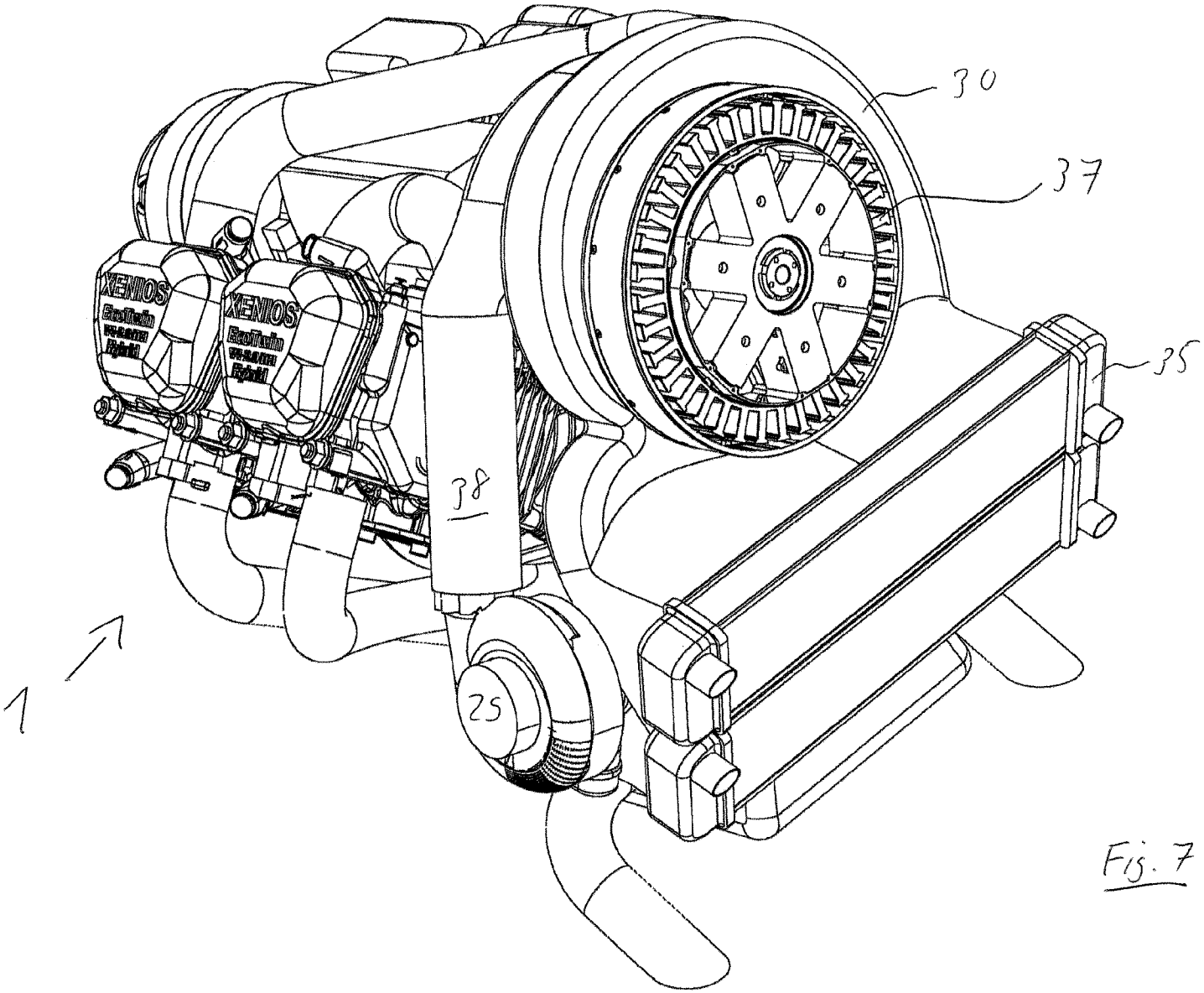
Figures 5, 8:
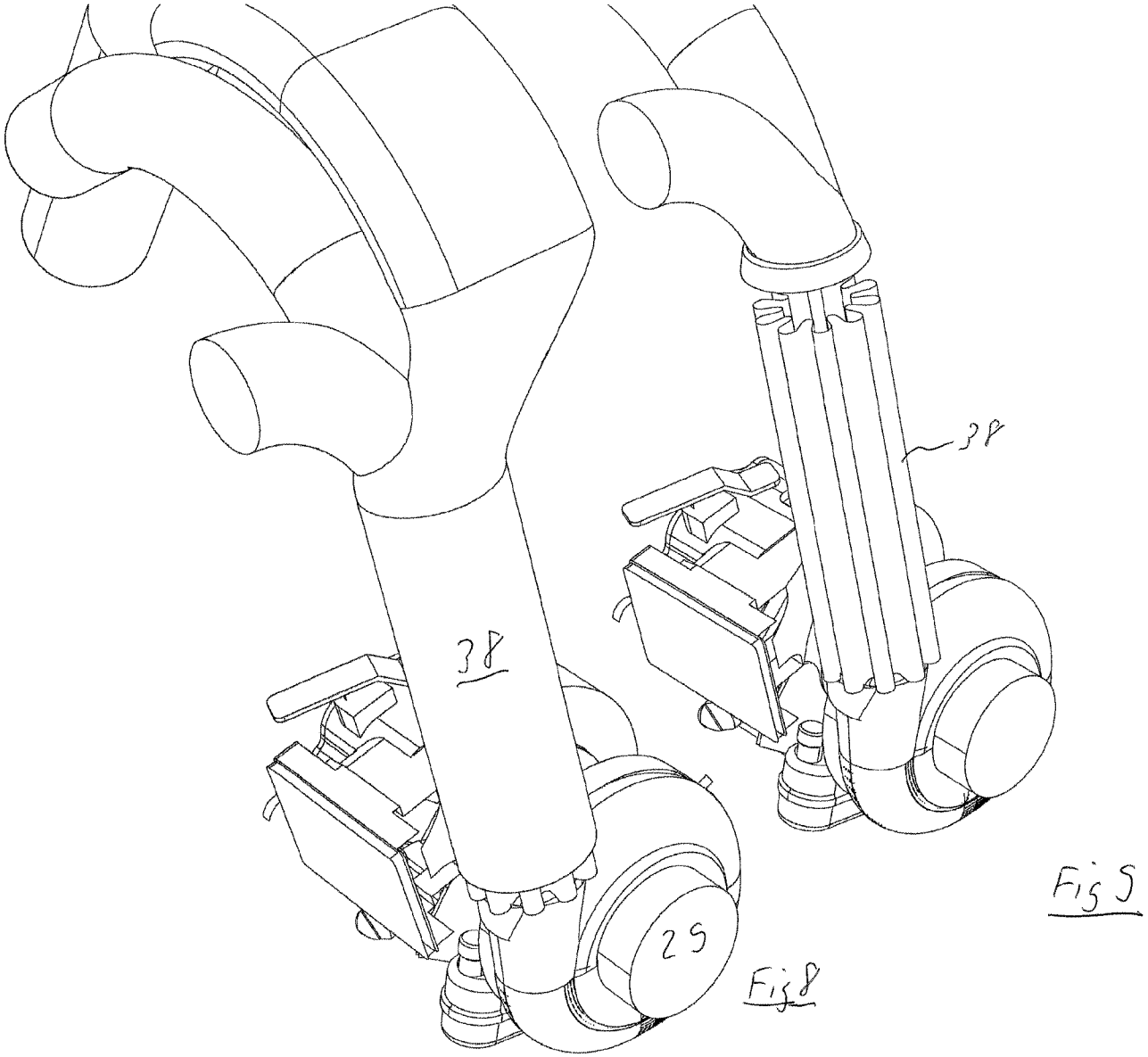
Figure 10:
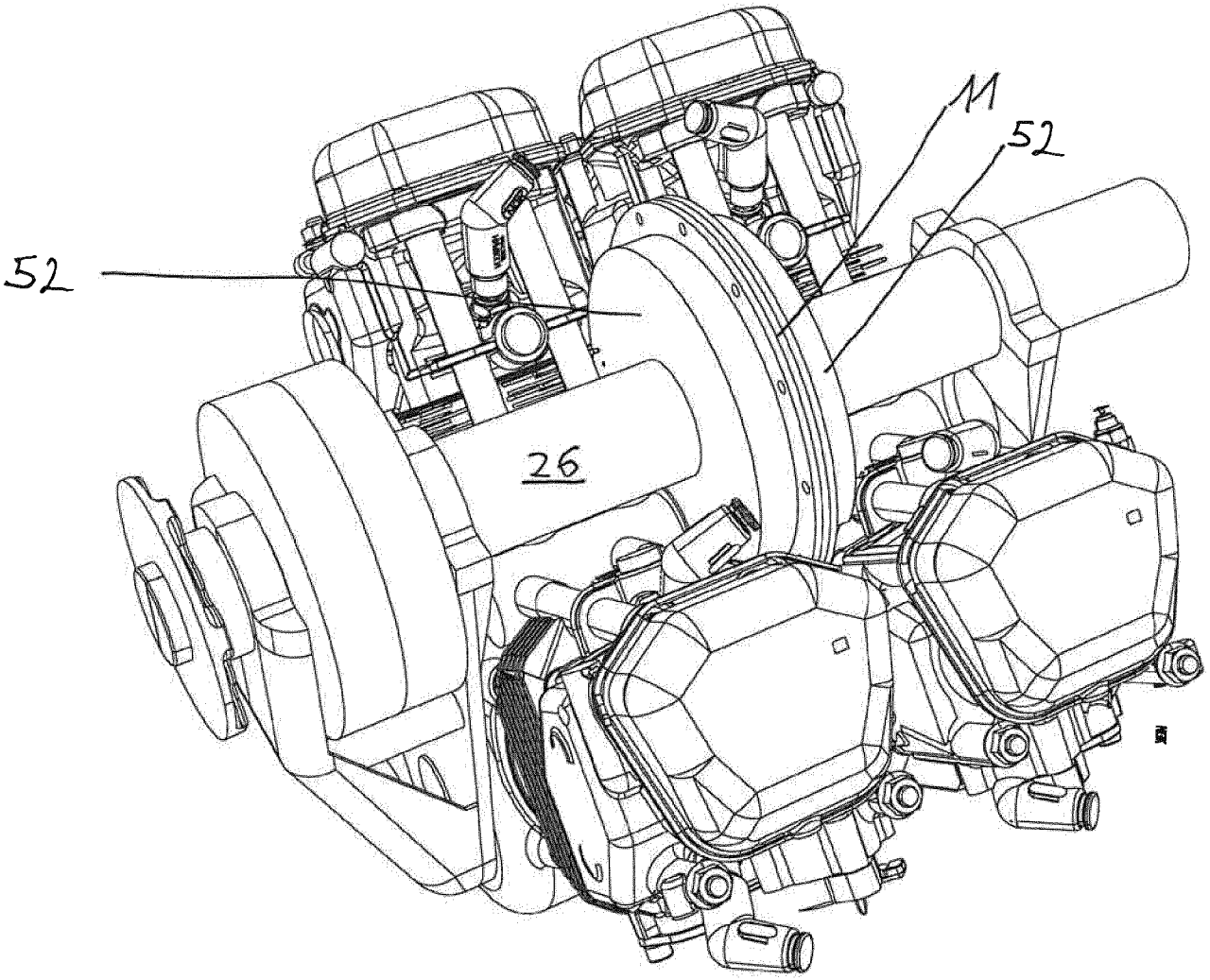
Figure 11:
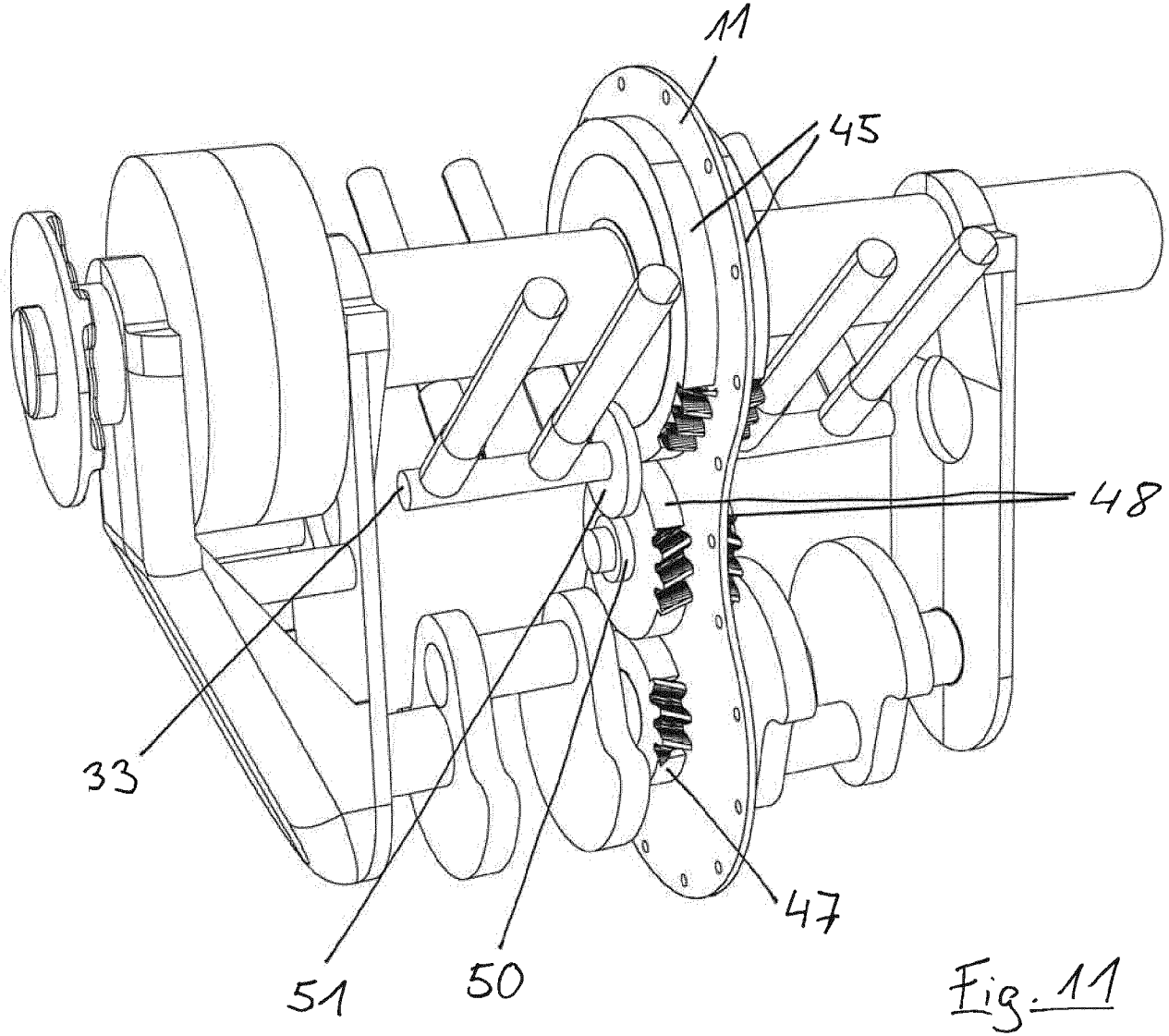
Figure 12:
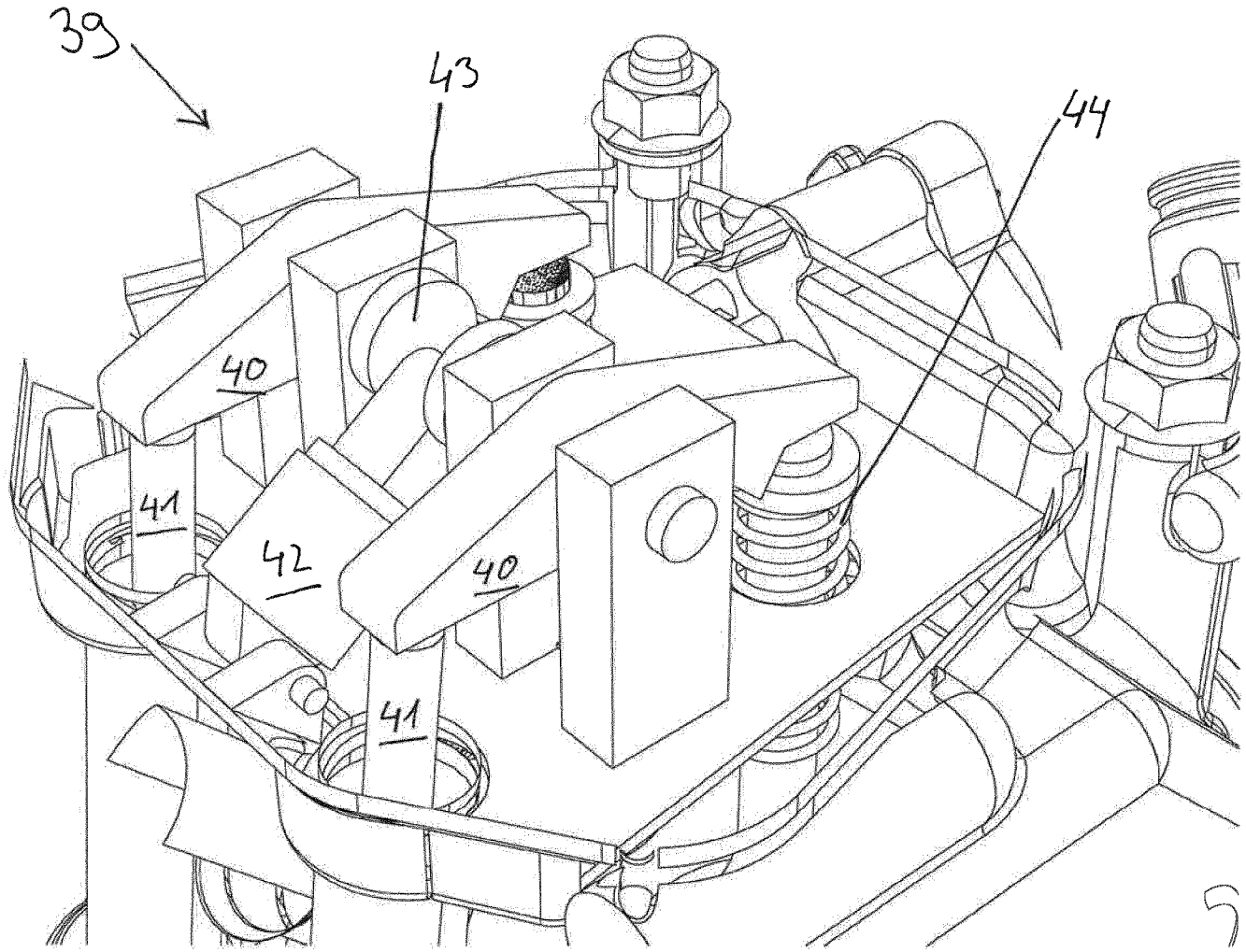
Figure 13:
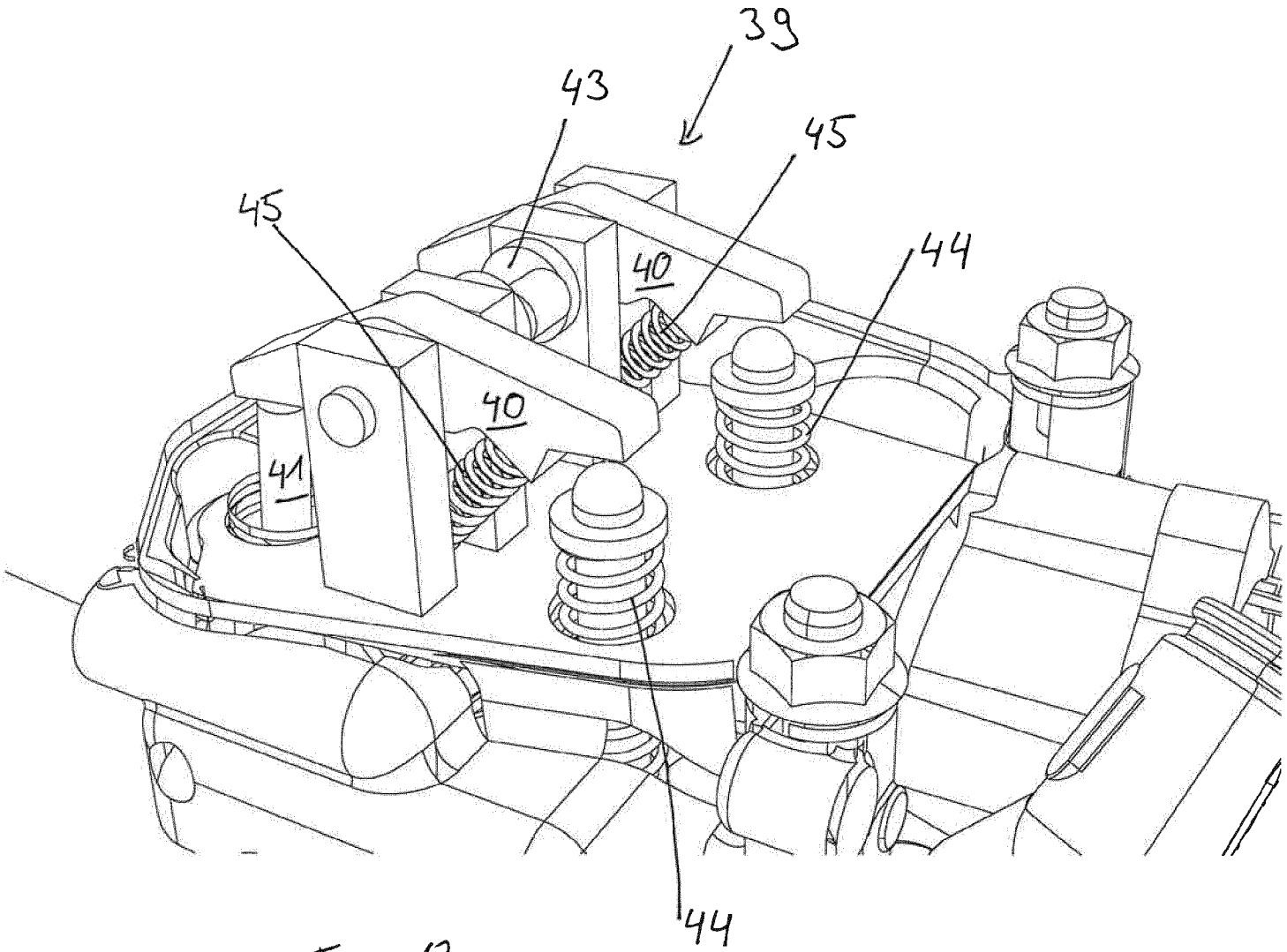
Figure 14:
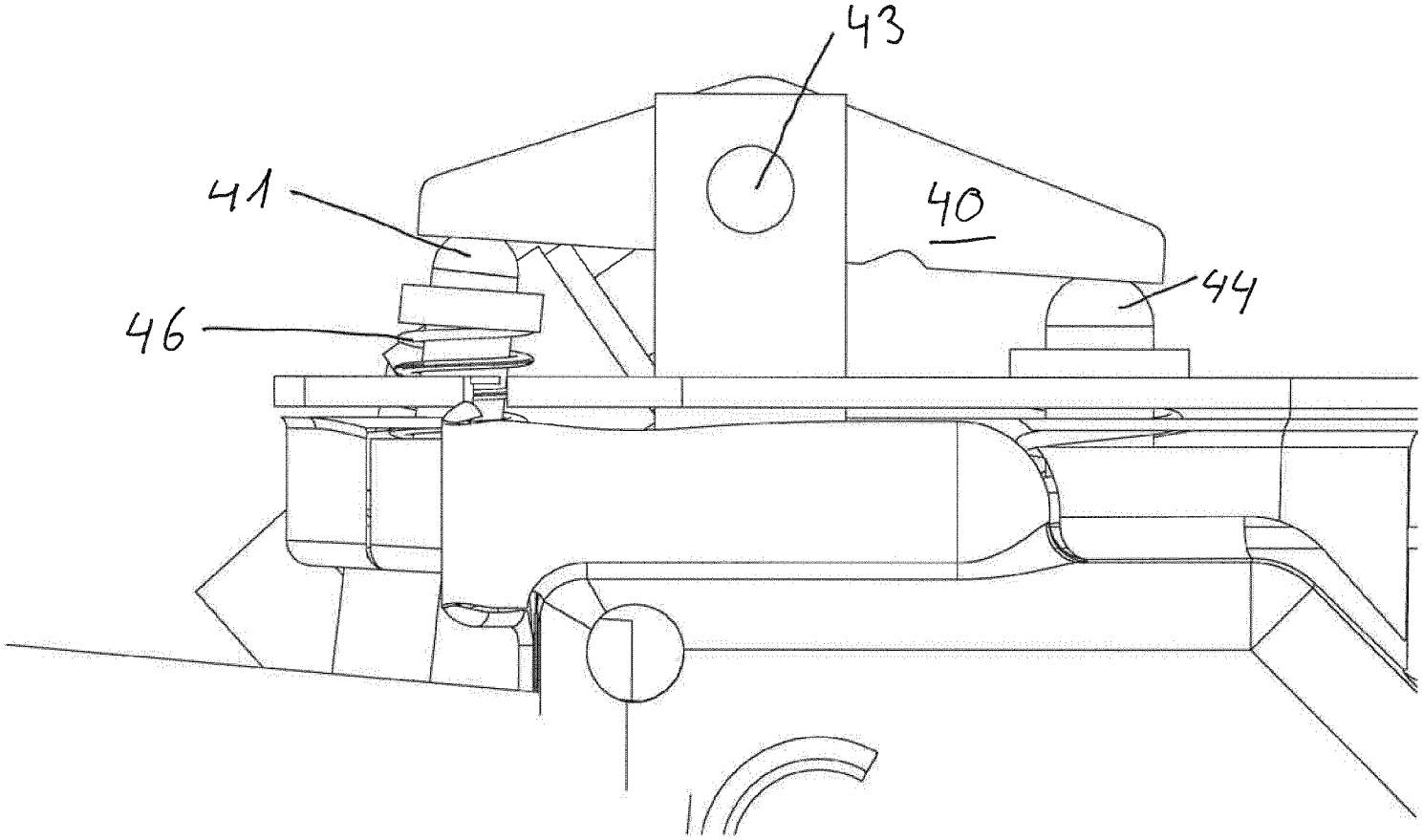

The invention will be explained in more detail below with reference to the drawings. In the drawings:

FIG. 1 shows a perspective view of an internal combustion engine according to the invention, FIG. 2 shows the internal combustion engine according to FIG. 1 in a lateral exploded view, FIG. 3 shows two cylinder blocks arranged in V-shape with the intermediate plate of the internal combustion engine according to the invention in an exploded perspective view, FIG. 4 shows the intermediate plate with first and second crankshafts and the camshaft drive and oil pump drive in a perspective view, FIG. 5 shows the intermediate plate with first and second crankshafts and camshaft and oil pump drive in a lateral sectional view, FIG. 6 shows a transmission and a clutch of the internal combustion engine in a detailed perspective view, FIG. 7 shows another perspective view of the internal combustion engine according to the invention, FIG. 8 shows a perspective view of a turbocharger with intercooler, FIG. 9 shows another perspective view of the turbocharger with intercooler, FIG. 10 shows a perspective view of the internal combustion engine according to the invention with two transmission housings provided on the intermediate plate, FIG. 11 shows the transmissions of the embodiment shown in FIG. 10 with a camshaft control in a perspective view, FIG. 12 shows means for decoupling rocker arms in a perspective view, FIG. 13 shows an alternative embodiment of the means for decoupling rocker arms in a perspective view, and FIG. 14 shows an alternative embodiment of the means for decoupling rocker arms in a perspective view.

One example embodiment of an internal combustion engine 1 according to the invention comprises two V-engines or engine blocks 2, 3 coupled to one another and each having two cylinders 4 (FIGS. 1-3). The engine blocks arranged in V-shape comprise respective cylinders or cylinder heads arranged in V-shape.

Each cylinder 4 has one piston (FIG. 4) arranged therein, each acting, with one connecting rod, upon a crankshaft 5, 6. The first and the second crankshafts 5, 6 of the first and the second engine block 2, 3 are thus designed separately, that means they are not connected to one another.

The crankshafts 5, 6 each have their ends borne on an intermediate plate 11 and a first and a second crankcase 8, 10, respectively. The intermediate plate 11 is arranged between the two crankcases 8, 10. The crankcases 8, 10 are arranged on the outer sides of the engine blocks 2, 3 facing away from the intermediate plate 11.

The intermediate plate 11 is adapted for sealing and connecting the first and the second engine blocks 2, 3 to a first and a second crankcase 8, 10 (FIGS. 2-5).

The intermediate plate 11 is a disk-shaped element having boreholes 12 arranged on its radial circumference, which are equally spaced apart from one another, for connecting it to the two crankcases 8, 10. In the middle of the intermediate plate 11, a bearing borehole 13 is arranged transversally with respect to the intermediate plate 11 (FIG. 5).

The bearing borehole 13 has one end 18, on the bearing side, of the first crankshaft 5 and one end 19, on the bearing side, of the second crankshaft 6 arranged therein.

The bearing-side end 18 of the crankshaft 5 is a tubular section 20. The bearing-side end 19 of the second crankshaft 6 is a pin-shaped section 21. The outer diameter of the pin-shaped section 21 is smaller than the inner diameter of the tubular section 20.

The bearing borehole 13 is a bearing means 17 such as a sliding bearing, a ball bearing, or a roller bearing provided between the inner surface of the bearing borehole and the outer surface of the tubular section 20.

The tubular section of the bearing-side end 18 of the first crankshaft 5 has another bearing means 17 arranged therein. In this bearing means and thus in the tubular section, the pin-shaped section 21 of the second crankshaft 6 is rotational-mounted.

Due to the bearing means 17 in the bearing borehole 13 and the further bearing means 17, the two crankshafts are, in their rotational movement, completely decoupled from one another.

The bearing borehole 13 is on both sides of the intermediate plate elongated by respective pipe parts 14 and has an extended diameter. The pipe parts 14 are connected to the intermediate plate 11 by means of additional reinforcing struts 15. The hollow spaces of the pipe parts form bearing openings 16.

These bearing openings 16 also have bearing means 17 arranged therein, in which crank cheeks 36 of the first and the second crankshafts 5, 6 are borne (FIG. 5).

The two crankshafts 5, 6 are thus, in the intermediate plate 11, borne both in the region of the crank cheek 36 and in the center of the bearing opening 13 of the intermediate plate 11. This makes it possible to make the axial distance of the bearings of each crankshaft large. This makes it possible to make the bearing distances of each crankshaft significantly larger than in the case in which, in the center of the intermediate plate, a separate bearing would be provided for each crankshaft portion.

Alternatively, it may also be provided that the bearing-side end 18 of the first crankshaft 5 and the bearing-side end 19 of the second crankshaft 6 are borne in a manner decoupled from one another, each in its own bearing means 17 in the bearing opening 16 (not shown).

The intermediate plate 11 has also a camshaft drive 22 and an oil pump drive 23 provided thereon (FIGS. 3-5).

The camshaft drive 22 and the oil pump drive 23 are designed as bevel gear transmissions and extend from the region of the bearing borehole 13, in which they engage one of the crankshafts 5, 6, radially to the outside up to the camshafts 33 or an oil pump. These drives may also be designed as spur gear transmissions or different types of transmissions.

Furthermore, a means 39 for, preferably mechanically, decoupling rocker arms 40 and the camshaft 33 is provided (FIGS. 12-14).

The means 39 comprises an eccentric shaft 41 on which the rocker arms 40 are borne in an eccentric manner such that the rotational point of the rocker arms 40 can be displaced such that the rocker arms 40 can, due to the displacement of the rotational points in the operated condition, no longer reach the valves 44.

Consequently, the valves remain closed even during a lifting movement of the pushing rod 41, thereby making it possible to switch off cylinders.

The eccentric shaft can be turned for example by means of a hydraulic cylinder 42. This hydraulic cylinder or the hydraulic cylinders can be controlled via a valve such as a magnetic valve, an electric valve or a mechanical valve. To operate the cylinder 42, the engine oil pressure from the engine circuit can be used.

The eccentric shaft 43 can thus be arranged in a "rocker arm is not engaged" position and in a "rocker arm is engaged" position.

Furthermore, a spring 45 may be provided, which presses the rocker arm onto the pushing rod 41 also when the eccentric shaft is rotated, thereby holding it on the camshaft 33.

The spring 45 ensures that the rocker arms 40 cannot freely swing when the eccentric shaft is turned, and thus that the pushing rod 41 is being held on the camshaft.

Alternatively, the eccentric shaft 43 may also be operated electromagnetically or mechanically.

According to an alternative embodiment, a spring 46 may be provided, which presses the pushing rod 41 upwards within the cylinder heads. This way, the rocker arm 40 also remains on the valve. This causes a distance between the camshaft 33 and the pushing rod 41 generated by turning the eccentric shaft 43, such that neither the pushing rod 41 nor the rocker arm 40 nor the valve 44 are operated. This also results in switching off cylinders by having the valves 44 remain closed.

Alternatively, the rocker arms 40 may also be mechanically decoupled from the camshafts 33 via a means that displaces the tappets, which this way can be disengaged from the rocker arms such that the tappets no longer have a connection to the rocker arms.

Alternatively, it may be provided that the pushing rods in the region of the camshaft are displaced such that the transmission of the lifting movement from the camshaft to the pushing rod is disengaged.

The first and second engine blocks 2, 3, arranged in a V-shape form, form in the region between their cylinders, a V-clearance 24. In the region of the V-clearance between the cylinder heads 25 of the cylinders 4, a drive shaft 26 is arranged.

The crankcases 8, 10 arranged on the outside each have a transmission 72 and a clutch 28 connecting the respective ends 7, 9, on the output sides of the first crankshaft 5 and the second crankshaft 6 to the drive shaft 26 arranged therein (FIG. 6). Such an arrangement of the transmissions 27 is referred to as external transmission arrangement.

The external gear engagements make it possible to achieve a small distance between the cylinder pairs of the two engine parts, thereby being able to achieve a high running smoothness.

The transmissions 27 are designed as belt transmissions. Alternatively, the transmissions 27 may also be designed as gear transmissions.

The two transmissions 27 may, according to a preferred embodiment, be arranged in the region in which the two engine blocks 2, 3 are connected to or coupled to one another. This means, the transmissions 27 are arranged in the region of the intermediate plate 11. Such arrangement of the transmissions 27 is referred to as internal transmission arrangement.

The transmissions 27 are then preferably designed as gear transmissions.

In particular, the transmissions 27 may be designed such that in each case a first gear 47 arranged on the crankshaft can be connected, via a second gear 48, to a third gear arranged on the output shaft 26. This makes it possible to design or construct the transmission smaller at a given transmission ratio.

Furthermore, it is provided that a fourth gear 50 arranged on a camshaft is, via a fourth gear coupled to the second gear 48, engaged in a way that the camshaft is driven or controlled via the gear pair consisting of the fourth and the fifth gear 50, 51.

The gears are covered by a housing 52 fixed to the intermediate plate 11.

The clutches 28 are designed as claw clutches. The claw clutches are designed such that one claw of one half of the claw clutch has a different geometry than the remaining claws such that this one claw can only be coupled into one correspondingly complementarily designed recess of the other half of the claw clutch. This ensures that the two halves of the clutches 28 can only engage one another in a certain rotational position.

Each of the two engine blocks 2, 3 is provided with a turbocharger 29. The internal combustion engine 1 is, due to the two separate turbocharger systems 29, designed redundantly with respect to the air supply. That means, if one engine part fails and the turbocharger is damaged, this only leads to a 50% loss of power, because the remaining engine part with turbocharger still reaches its full power.

Alternatively, one single turbocharger is also conceivable.

In a pipe part provided between the turbochargers 29 and the intake bends to the cylinders, intercoolers (FIGS. 7-9) for cooling the compressed and heated intake air are integrated. These coolers are formed of lamella-like pipe parts to increase their surface area. In the interior part of these pipe parts, the compressed and heated air flows from the turbochargers to the intake pipes and dissipates the heat to the corrugated pipe lamellae. On the outside of the pipe lamellae, cooling air flows in the opposite direction around the lamellae, thereby dissipating the heat. The opposing airflows render an optimum cooling effect combined with a very small installation space and low weight.

The output shaft 26 has two centrifugal fans 31 provided thereon. Due to the centrifugal fans, the engine does not have to be supplied with an external cooling airflow. Due to the centrifugal fans, the cylinders are always cooled as long as the drive shaft is rotating, which means that the engine is running.

In the region of the second engine block 3, a water cooling means 35 having two separate cooling circuits for cooling the two engine blocks 2, 3 is provided.

In addition, a cooling fan 30 is provided in this region to increase the cooling capacity. This cooling fan 30 provides an airflow both for the two intercoolers and for the water cooling means 35. A fan housing of the cooling fan is designed such as to guide, in the upper region, part of the cooling air flow to the intercoolers. The lower region ensures that the cooling air flow is supplied to the water cooling means 35.

On one end 32, on the output side, of the drive shaft, two separate generators 34 are provided to ensure sufficient power supply at any time, which means also if one generator fails. These generators may also be electric drives, thus forming a hybrid drive.

The camshaft drive explained above is arranged at the center of the intermediate plate. Alternatively, the camshaft drive and the oil pump drive may be arranged on the opposite/external housing sides.

For further enhancing the failure safety and/or to provide an additional increase in power, the internal combustion engine may additionally comprise an electric drive (FIGS. 2-7) such that the internal combustion engine is designed as a hybrid drive. With the electric drive, sufficient power and sufficient torque on the drive shaft can be provided for emergency operation (for example for reaching the next airport) in order to drive a vehicle, in particular an aircraft, equipped with the internal combustion engine, even if both engine blocks of the internal combustion engine fail.

The process of coupling-in and coupling-out the two engine blocks is described in the following in further detail.

In order to shut down one of the two engine blocks in case of loss of torque or complete failure, sensors are provided, by means of which an operating condition of the two engine blocks can be detected independently from one another.

These sensors may preferably be adapted for independently detecting the torque of the two engine blocks or the exhaust gas temperatures of the two engine blocks or for detecting other suitable characteristics for determining the operating condition. These sensors are therefore in the following subsumed with the term operating condition sensors.

The operating condition sensors may be arranged as torque sensors in both clutches. The torque sensors may be implemented as electronic sensors for torque detection, for example as piezoelectric sensors or contact-free torque sensors. The Fraunhofer ITWM sells an inductive sensor for contact-free detection of torque. The measuring concept of this sensor is based on the anisotropic magnetostrictive effect in ferromagnetic shaft surfaces. This effect causes, depending on the mechanical torsional stresses on the place of measurement, a different magnetic permeability in direction of the tensile stresses and compressive stresses. The sensor serves to measure this change in permeability, which is, in a large measurement range, proportional to the torsional stress on the shaft surface.

Another possibility for torque detection is to provide, on the transmission, a spring-loaded pulley, such as a tensioner pulley, abutting on one run of the belt. Depending on whether the belt transmission drives the drive shaft or the engine block, either the one or the other run of the belt is under tension. This tension can be detected with the tensioner pulley and a corresponding sensor.

In addition and/or alternatively, at least two exhaust sensors may be provided, which are integrated into the exhaust system of the two engine blocks such that the exhaust gas temperatures of the two engine blocks can be monitored independently from one another.

The internal combustion engine according to the invention comprises a controller (not shown), which monitors the torque and/or the exhaust gas temperature of the two engine blocks by means of the sensors. As soon as the torque of one of the two engine blocks has, over a longer period of time, for example more than 0.5 or 1 or 1.5 or 2 or 3 or 4 seconds, a predetermined difference from the other engine block, the controller controls the clutch of the respective engine block and decouples it. This way, the crankshaft of this engine no longer has to rotate along and the other engine can continue to operate without the friction resistance of the failing engine block.

Aside from these automatic decoupling processes by means of a controller, manual decoupling may also be provided additionally or alternatively.

If one motor part no longer operates correctly, the driver, in particular the pilot, is notified by the control electronics. They can then decouple the respective engine by manually or electrically operating the respective clutch.

If the clutches are designed as claw clutches, the engine can only be coupled-in again during standstill or after landing, because this requires that the correct rotation angle position of the two engines with respect to one another must be ensured.

In the preferred composition, the internal combustion engine according to the invention comprises two—apart from the mirrored camshaft—completely identical engines or engine blocks, which can each be operated alone.

One possibility to reduce components would, for example, be to separate the cooling water containers and oil containers as well as the coolers on the side of the circuit, while, however, combining the double containers or coolers in one respective double component.

It is also possible to employ other clutches, which accomplish the function of an unambiguous angular position, as a clutch.

Alternatively, it may be possible to couple-in during operation, provided it is possible to provide a clutch that ensures, during operation, the unambiguous angular position during the process of coupling-in. In case of an emergency, it would also be conceivable to couple-in if the two engine parts have a random angular position with respect to one another; however, in this case, the imbalances of the two engine parts may, in an unfavorable case, add up and thus double.

The two transmissions may also be arranged in the region of the intermediate plate.

The at least two engine blocks are preferably arranged in a V-shape. However, they may also be arranged in a boxer arrangement or in-line arrangement.

With the principle according to the invention, it is also possible to connect more than two, for example three or four, engine blocks.

According to another embodiment, not only two two-cylinder engine blocks, or two engine blocks with two cylinders, but also for example four four-cylinder engine blocks, one four-cylinder engine block and one two-cylinder engine block, or two three-cylinder engine blocks, are coupled in a manner according to the invention in order to be able to realize small but even more powerful units. Principally, it is also possible to couple three two-cylinder engine blocks, wherein a distance needs to be kept between two engine blocks in order to provide a transmission and a clutch for the output to the drive site.

Alternatively, it is also conceivable to couple two or more engine blocks to one another in a manner according to the invention.

Principally, an engine block may also comprise only one cylinder.

The engine blocks may also be adapted as in-line engines or boxer engines.

The internal combustion engine according to the invention comprises all components required for operating one engine block of the engine twice; merely the drive shaft is provided only once. That means, there are two completely separate power supply systems which are supplied by two separate generators and connected to the on-board power system via diodes for safeguarding. The engine according to the invention comprises two separate cooling circuits and oil circuits and correspondingly two cooling pumps and two oil pumps. That means, even if one engine block fails, the operation of the second engine block is still ensured.

LIST OF REFERENCES

1 internal combustion engine
2 first engine block
3 second engine block
4 cylinder
5 first crankshaft
6 second crankshaft
7 end on the output side
8 first crankcase
9 end on the output side
10 second crankcase
11 intermediate plate
12 boreholes
13 recesses
14 pipe part
15 reinforcing struts
16 bearing borehole
17 bearing means
18 end on the bearing side
19 end on the bearing side
20 tube-shaped section
21 pin-shaped section
22 camshaft drive
23 oil pump drive
24 V-clearance
25 cylinder head
26 drive shaft
27 transmission
28 coupling
29 turbocharger
30 fan
31 centrifugal fan
32 end of the drive shaft on the output side
33 camshaft
34 generator
35 water cooling means
36 crank cheek
37 electric drive
38 intercooler
39 means for decoupling rocker arms
40 rocker arm
41 pushing rod
42 hydraulic cylinder
43 eccentric shaft
44 valve
45 spring
46 spring
47 first gear
48 second gear
49 third gear
50 fourth gear
51 fifth gear
52 housing

The invention claimed is:

1. An internal combustion engine, comprising at least two engine blocks which are coupled to one another and each of which includes at least one cylinder, each crankshaft of each of the engine blocks being connected to a common drive shaft via a respective transmission and clutch, wherein each crankshaft of each of the engine blocks can be decoupled from the drive shaft via the corresponding clutch individually and the two engine blocks are arranged in a V-shape such that cylinder heads of the cylinders are arranged in a V-shape and that the drive shaft is arranged in the region of the V-clearance between the cylinder heads.

2. The internal combustion engine according to claim 1, wherein each clutch of each engine blocks couples the respective crankshaft to the drive shaft only in one single angular position.

3. The internal combustion engine according to claim 1, wherein the clutches are claw clutches.

4. The internal combustion engine according to claim 1, wherein the engine comprises a bottom-mounted camshaft.

5. The internal combustion engine according to claim 4, wherein a means for decoupling rocker arms and tappets is provided such as to allow for switching off cylinders.

6. The internal combustion engine according to claim 1, wherein a water cooling means for cooling cylinder heads of the cylinders is provided, wherein the drive shaft has at least one centrifugal fan, which is also adapted for additionally cooling the cylinders, arranged thereon.

7. The internal combustion engine according to claim 1, wherein the engine blocks each comprise at least four, six or more cylinders.

8. The internal combustion engine according to claim 1, wherein the internal combustion engine also comprises an electric drive, thus being adapted as a hybrid drive.

9. The internal combustion engine according to claim 1, further comprising operating condition sensors for detecting the operating conditions of the engine blocks.

10. The internal combustion engine according to claim 9, wherein the operating condition sensors generate a signal or are coupled to a controller which disconnects one engine block that is not running or only partially running from the drive shaft by decoupling it.

11. The internal combustion engine according to claim 1, further comprising an intermediate plate for connecting the at least two engine blocks, wherein the intermediate plate is a plate-shaped component, wherein the intermediate plate also comprises at least one bearing borehole for receiving at least one bearing of a crankshaft.

12. The internal combustion engine according to claim 11, wherein the bearing borehole is adapted for coaxially bearing the two crankshafts.

13. The internal combustion engine according to claim 12, wherein the intermediate plate comprises two sealing faces adapted for respectively sealing one side of the engine blocks.

14. The internal combustion engine according to claim 11, wherein the intermediate plate comprises two sealing faces adapted for respectively sealing one side of the engine blocks.

15. The internal combustion engine according to claim 11, wherein the intermediate plate is adapted for receiving the transmissions and/or camshaft drives.

16. An internal combustion aircraft engine, comprising at least two engine blocks which are coupled to one another and each of which includes at least two cylinders, wherein each crankshaft of each of the engine blocks is connected to a common drive shaft via a respective transmission and clutch, and the drive shaft is located on an opposite side of the engine blocks from each crankshaft and in the region of a V-clearance between the cylinder heads.

17. The internal combustion engine according to claim 16, wherein the clutches are claw clutches.

18. An internal combustion aircraft engine, comprising at least two engine blocks which are coupled to one another and each of which includes at least two cylinders in a V-shape, wherein each crankshaft of each of the engine blocks is connected to a common drive shaft via a respective transmission and clutch; and the drive shaft is located in a clearance between the two cylinders of each of the two engine blocks.

* * * * *